US006371391B1

(12) United States Patent
Reiter

(10) Patent No.: US 6,371,391 B1
(45) Date of Patent: Apr. 16, 2002

(54) FUEL INJECTION VALVE

(75) Inventor: Ferdinand Reiter, Markgröningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/622,084

(22) PCT Filed: Sep. 15, 1999

(86) PCT No.: PCT/DE99/02931

§ 371 Date: Sep. 27, 2000

§ 102(e) Date: Sep. 27, 2000

(87) PCT Pub. No.: WO00/34648

PCT Pub. Date: Jun. 15, 2000

(30) Foreign Application Priority Data

Dec. 10, 1998 (DE) ..... 198 56 920

(51) Int. Cl.[7] ..... B05B 1/30; F02M 51/00; F02M 59/00; F02M 61/00; F02M 63/00

(52) U.S. Cl. ..... 239/585.1; 239/585.3; 239/585.5; 239/533.2

(58) Field of Search ..... 239/585.1, 585.2, 239/585.3, 585.4, 585.5, 584, 533.2, 533.3, 533.12, 600, 900; 29/17.3, 412, 890.122, 890.129, 890.132

(56) References Cited

U.S. PATENT DOCUMENTS 3,978,705 A * 9/1976 Pearce et al. ..... 72/325
4,774,976 A * 10/1988 Janecke et al. ..... 137/14
5,002,231 A 3/1991 Krauss et al.
5,570,843 A * 11/1996 Heyse et al. ..... 239/585.1
5,820,032 A * 10/1998 Reiter ..... 239/585.1
5,921,473 A * 7/1999 Romann ..... 239/585.1
6,168,099 B1 * 1/2001 Hopf et al. ..... 239/596

FOREIGN PATENT DOCUMENTS

DE 40 26 721 2/1992
DE 41 23 692 1/1993

* cited by examiner

*Primary Examiner*—David A. Scherbel
*Assistant Examiner*—Davis Hwu
(74) *Attorney, Agent, or Firm*—Kenyon & Kenyon

(57) ABSTRACT

A fuel injection valve having an energizable actuation device and having a valve member, movable by the actuation device, that is joined to a valve closure element. The valve closure element cooperates with a valve seat surface in order to open and close the valve. Arranged downstream from the valve seat surface is an orifice disk that is configured, with a bottom part and a retaining rim projecting out therefrom, in cup- or pot-shaped fashion. The thin orifice disk made of sheet metal has, in the transition region of the bottom part to the retaining rim, protrusions which enhance the rigidity of the orifice disk. The fuel injection valve is suitable in particular for fuel injection systems of mixture-compressing spark-ignited internal combustion engines.

8 Claims, 2 Drawing Sheets

FUEL INJECTION VALVE

BACKGROUND INFORMATION

The present invention is based on a fuel injection valve.

German Published Patent Application No. 40 26 721 A1 has already disclosed an injection valve that has a thin cup-shaped orifice disk at its downstream end. This orifice disk possesses a flat bottom part having a plurality of spray discharge openings, and a retaining rim projecting out therefrom, thus creating a pot or cup shape. The orifice disk is attached in the region of its bottom part to a valve seat element by way of a peripheral weld seam, while the retaining rim is immovably joined to a valve seat support by welding. In order to prevent the orifice disk from lifting off as a result of the prevailing fuel pressure, the orifice disk must be of sufficient thickness. The thickness of the orifice disk thereby defined creates the disadvantage that the fuel emerging from the spray discharge openings is not optimally atomized into ultrafine fuel droplets, i.e. that ideal fuel conditioning is not achieved.

It has therefore already been proposed in German Patent No. 41 23 692 to provide a support disk in addition to the orifice disk. The support disk possesses a cup-shaped configuration that grips, between its bottom part and the valve seat element, a flat orifice disk that bulges in a domed shape in its central region. The orifice disk is thus easy to manufacture and can be made relatively thin. The disadvantages mentioned above can be overcome with a design of this kind, but the manufacture of two components entails considerable additional effort, the support disk being thicker than the orifice disk. In addition to the additional component, considerable extra material is also necessary. Handling during mounting of the two components is also more difficult than in the case of a single orifice disk.

SUMMARY OF THE INVENTION

The fuel injection valve according to the present invention has, in contrast, the advantage that it has an orifice disk which is configured in a particularly simple manner with absolutely no additional need for additional material or components, and which has greater stability and rigidity as compared to known orifice disks of the same thickness. Improved dynamic long-term durability is also achieved. As a result of the features according to the present invention for increasing the rigidity of the orifice disk, it is possible to make the orifice disk thinner than previously, and thus easily to maintain a specific ratio, occurring under certain installation conditions, between the orifice disk thickness and the orifice diameter of the spray discharge openings.

Advantageously, the protrusions are made in the form of crimps that can be produced by stamping on the orifice disk, which constitutes a sheet-metal part. It is advantageous if at least three protrusions are provided, distributed over the circumference.

DETAILED DESCRIPTION

Figure 1:
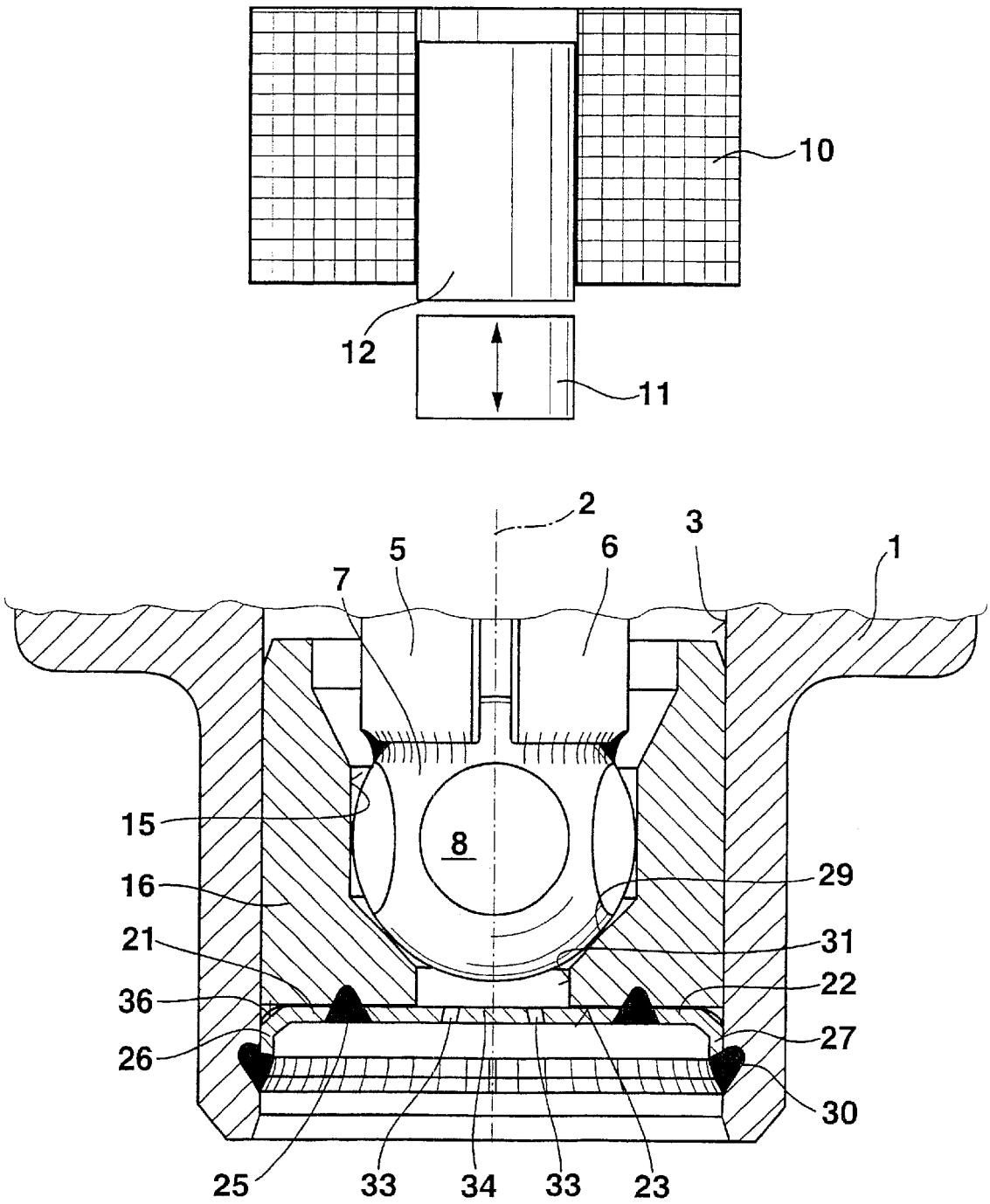
FIG. 1 shows a partially depicted fuel injection valve.

FIG. 1 partially depicts a valve in the form of an injection valve for fuel injection systems of mixture-compressing spark-ignited internal combustion engines, which has an orifice disk according to the present invention.

The injection valve has a tubular valve seat support 1 in which a longitudinal opening 3 is configured concentrically with a longitudinal valve axis 2. Arranged in longitudinal opening 3 as an axially movable valve member is a, for example, tubular valve needle 5 that is immovably joined at its downstream end 6 to a, for example, spherical valve closure element 7 on whose periphery, for example, five flattened areas 8 are provided past which the fuel can flow.

Actuation of the injection valve is accomplished in a known manner, for example electromagnetically in this case. Also conceivable, however, is, for example, piezoelectric actuation. A schematically indicated electromagnetic circuit having a magnet coil 10, an armature 11, and a core 12 serves to move valve needle 5 axially and thus to open the injection valve against the spring force of a return spring (not depicted), and to close it. Armature 11 is joined to the end of valve needle 5 facing away from valve closure element 7 by way of, for example, a weld seam produced with a laser, and is directed toward core 12.

Guidance of valve closure element 7 during axial movement is provided by a guide opening 15 of a valve seat element 16 that is installed sealedly, by welding, in longitudinal opening 3 in the end of valve seat support 1 lying downstream. Valve seat element 16 is joined, concentrically and immovably, to an orifice disk 21 of pot- or cup-shaped configuration, orifice disk 21 resting, with a bottom part 22, directly against a lower end surface 23 of valve seat element 16.

Adjoining bottom part 22 of orifice disk 21 is a peripheral retaining rim 26 that extends in the axial direction away from valve seat element 16 and is bent slightly conically outward toward one end 27. Retaining rim 26 has at its end 27 a slightly greater diameter than the diameter of longitudinal opening 3 of valve seat support 1. Valve seat element 16 and orifice disk 21 are joined, for example, by way of a peripheral and sealed first weld seam 25 configured by way of a laser. Orifice disk 21 is furthermore joined, at end 27 of retaining rim 26, to the wall of longitudinal opening 3 in valve seat support 1, for example by way of a peripheral and sealed second weld seam 30.

The spherical valve closure element 7 cooperates with a valve seat surface 29 of valve seat element 16 that is configured downstream from guide opening 15 and tapers, for example, in conical form in the flow direction. One end position of valve needle 5, when magnet coil 10 is not energized, is defined by contact of valve closure element 7 against valve seat surface 29. The other end position of valve needle 5, when magnet coil 10 is energized, is defined, for example, by contact of armature 11 against core 12. The travel between the two end positions represents the needle stroke.

Fuel flowing past valve seat surface 29 when the valve is open passes into a discharge opening 31 in valve seat element 16 that is, for example, of cylindrical configuration. The fuel then passes through one or more, for example four, spray orifices 33 produced by punching, electrodischarge machining, or laser drilling, that are present in a central region 34 of bottom part 22 of orifice disk 21. Out of these spray orifices 33 fuel is discharged, for example, into the intake duct of an internal combustion engine close to an intake valve.

In very general terms, orifice disks mounted on injection valves control, with their orifices, the flow quantity, spray shaping, and flow conditioning of the fuel. Advantageously, orifice disks 21 can be produced as deep drawn cups which, as already described, have a bottom part 22 and a retaining rim 26 projecting out therefrom. Orifice disks 21 of this kind thus perform further functions, such as indirect attachment of valve seat element 16, adjustment of the linear stroke of valve needle 5 and, via weld seams 25 and 30, sealing in order to prevent any undesired flow of fuel beyond spray orifices 33. In order to create spray angles at predefined static flow rates, for manufacturing and functional reasons a specific and relatively precise relationship is maintained between the sheet-metal thickness (at least of bottom part 22) and the respective diameter of spray orifices 33.

For certain applications, a constrained ratio of this kind between sheet-metal thickness and orifice diameter can result in the need for relatively thin sheet-metal thicknesses for orifice disks 21. Particularly thin sheet-metal orifice disks 21 of this kind are, however, exposed to correspondingly greater mechanical stress. According to the present invention, the intention is to increase the stability and rigidity of orifice disk 21 without providing additional support elements in the manner known from the document German Patent No. 41 23 692.

Figure 3:
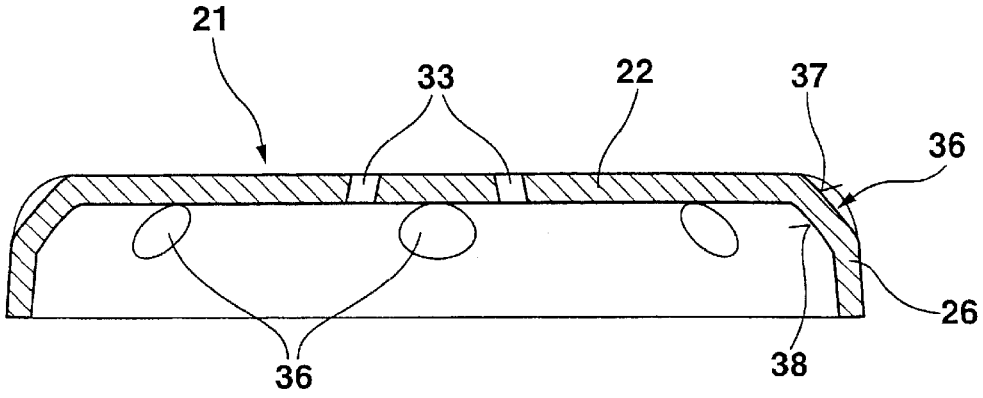
FIG. 3 shows a section through the orifice disk as shown in FIG. 2, along line III—III in FIG. 2.
Figure 2:
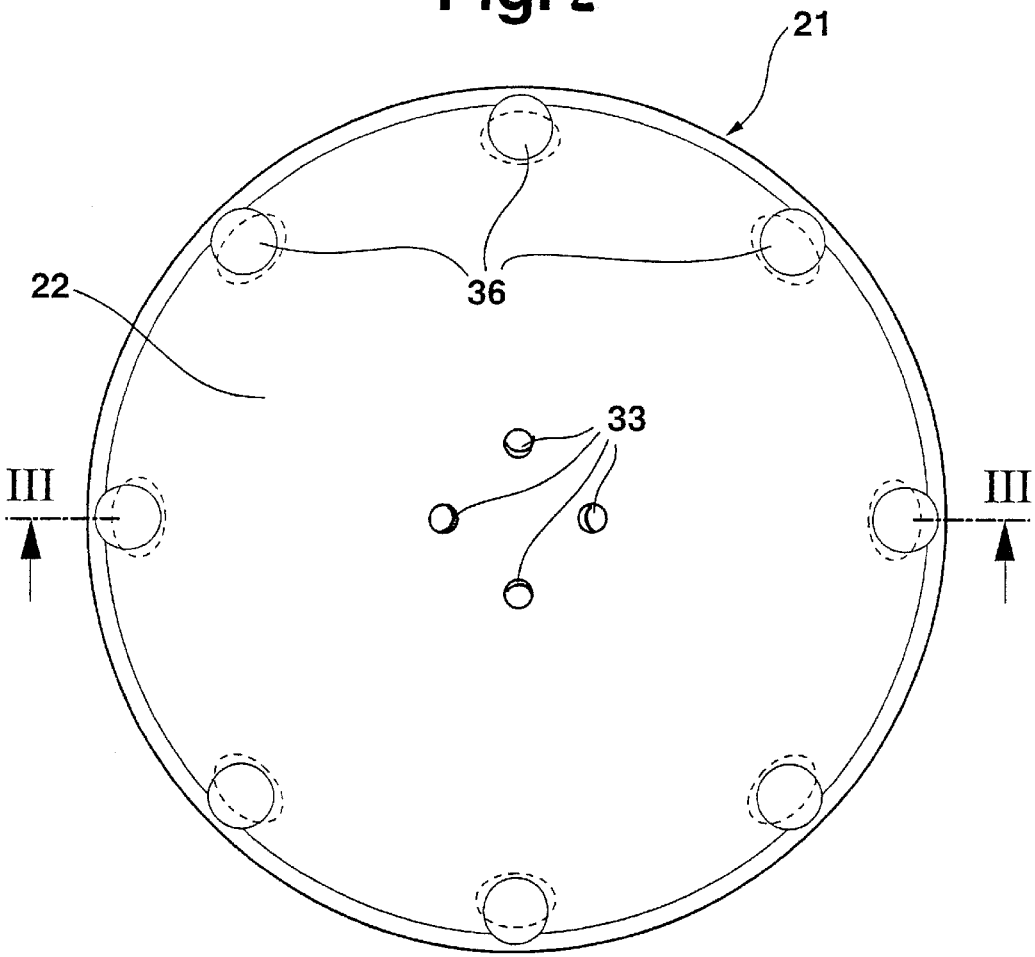
FIG. 2 shows an orifice disk according to the present invention.

FIG. 2 shows an orifice disk 21 according to the present invention in a plan view, while FIG. 3 is a sectioned depiction through orifice disk 21 along line III—III in FIG. 2. Several crimps 36 or other stability-enhancing surfaces are therefore configured in the transition region of bottom part 22 to retaining rim 26, in order to enhance the rigidity of orifice disk 21. Ideally, crimps 36 are shaped by stamping; at least three but, for example as depicted in FIGS. 2 and 3, eight crimps 36 are configured over the circumference. As is evident from FIG. 2, the (for example) eight crimps 36 can be shaped at respective spacings of 45° from one another. An orifice disk 21 stiffened in this simple fashion also has the advantage of improved dynamic long-term durability.

Crimps 36 are applied, for example, in such a way that crimp depressions are present from upper side 37 of orifice disk 21 (facing toward valve seat element 16) with respect to the material surrounding crimps 36. Correspondingly, crimps 36 form crimp elevations on upper side 37 of orifice disk 21 (opposite lower side 38) with respect to the material surrounding crimps 36. Crimps 36 possess, for example, a circular shape, an oval shape, or a similar configuration.

Orifice disk 21 can also, for example, be installed in the injection valve with a retaining rim 26 that projects upward axially upstream.

What is claimed is:

1. A fuel injection valve, comprising:

an energizable actuation device;

a valve seat surface;

a valve member movable by the energizable actuation device that cooperates with the valve seat surface in order to open and close; and an orifice disk arranged downstream from the valve seat surface and including at least one spray orifice, the at least one spray orifice having a form that is one of cup-shaped and pot-shaped and including a bottom part and a retaining rim projecting out therefrom, wherein: the orifice disk includes in a transition region of the bottom part to the retaining rim protrusions that enhance a rigidity of the orifice disk.

2. The fuel injection valve according to claim 1, wherein: the protrusions correspond to one of crimps and shaped-on surfaces.

3. The fuel injection valve according to claim 1, wherein: the protrusions are produced by a stamping operation.

4. The fuel injection valve according to claim 1, wherein: the orifice disk includes a sheet-metal part.

5. The fuel injection valve according to claim 1, wherein: the protrusions include at least three protrusions.

6. The fuel injection valve according to claim 1, wherein: the protrusions include depressions toward an upper side of the orifice disk, and the protrusions include elevations toward a lower side of the orifice disk.

7. The fuel injection valve according to claim 1, wherein: the protrusions have a shape that is one of a circular shape, an oval shape, and a mixed shape of circular and oval.

8. The fuel injection valve according to claim 1, wherein: the orifice disk includes four spray orifices provided in the bottom part.

* * * * *